US010228092B2

(12) United States Patent
De Bondt et al.

(10) Patent No.: US 10,228,092 B2
(45) Date of Patent: Mar. 12, 2019

(54) LIGHTING DEVICE COMPRISING A DRIVER UNIT AND METHOD OF MANUFACTURING THE SAME

(71) Applicant: PHILIPS LIGHTING HOLDING B.V., Eindhoven (NL)

(72) Inventors: Guy Louis Paul De Bondt, Eindhoven (NL); Coen Theorodus Hubertus Fransiscus Liedenbaum, Eindhoven (NL); Christian Hattrup, Eindhoven (NL); Georg Sauerländer, Eindhoven (NL); Adrianus Sempel, Eindhoven (NL); Henricus Franciscus Bonekamp, Eindhoven (NL); Theodorus Johannes Petrus Van Den Biggelaar, Eindhoven (NL)

(73) Assignee: PHILIPS LIGHTING HOLDING B.V., Eidhoven (NL)

( * ) Notice: Subject to any disclaimer, the term of this patent is extended or adjusted under 35 U.S.C. 154(b) by 0 days.

(21) Appl. No.: 15/549,588

(22) PCT Filed: Feb. 9, 2016

(86) PCT No.: PCT/EP2016/052731
§ 371 (c)(1),
(2) Date: Aug. 8, 2017

(87) PCT Pub. No.: WO2016/128402
PCT Pub. Date: Aug. 18, 2016

(65) Prior Publication Data

US 2018/0023769 A1 Jan. 25, 2018

(30) Foreign Application Priority Data

Feb. 12, 2015 (EP) ..... 15154806

(51) Int. Cl.
*F21K 9/23* (2016.01)
*F21V 3/00* (2015.01)
(Continued)

(52) U.S. Cl.
CPC ..... *F21K 9/23* (2016.08); *F21V 23/023* (2013.01); *H01F 27/38* (2013.01); *H01F 30/10* (2013.01);
(Continued)

(58) Field of Classification Search
CPC ..... F21K 9/23; H21V 23/023
See application file for complete search history.

(56) References Cited

U.S. PATENT DOCUMENTS

2003/0057871 A1* 3/2003 Kominami ..... H05B 41/2855 315/224
2008/0315784 A1* 12/2008 Tseng ..... H05B 33/0803 315/250
(Continued)

FOREIGN PATENT DOCUMENTS

CN 1885641 A 12/2006
CN 201983053 U 2/2011
(Continued)

*Primary Examiner* — Dedei K Hammond
*Assistant Examiner* — Raymond R Chai
(74) *Attorney, Agent, or Firm* — Akarsh P. Belagodu

(57) ABSTRACT

A lighting device (100) and a method of manufacturing a lighting device, wherein the lighting device comprises at least one light source (110) arranged to generate light. The lighting device further comprises a light-transmissive envelope (120) enclosing the at least one light source and being arranged to transmit the light generated from the light source. The lighting device further comprises a driver unit (130) arranged for electrical supply to the at least one light source, the driver unit comprising a primary driver circuit (140) connectable to an electric energy source, at least one secondary driver circuit (150) connected to the at least one
(Continued)

light source, and a transformer (160) arranged to transfer electrical energy between the primary driver circuit and the at least one secondary driver circuit, wherein at least the transformer and the at least one secondary driver circuit driver unit are arranged within the envelope.

12 Claims, 3 Drawing Sheets

(51) Int. Cl.

| | |
|---|---|
| ***F21V 3/06*** | (2018.01) |
| ***F21V 23/00*** | (2015.01) |
| ***F21V 23/02*** | (2006.01) |
| ***H01F 27/38*** | (2006.01) |
| ***H01F 30/10*** | (2006.01) |
| ***F21Y 115/10*** | (2016.01) |

(52) U.S. Cl.
CPC ..... *F21V 3/00* (2013.01); *F21V 3/061* (2018.02); *F21V 23/005* (2013.01); *F21Y 2115/10* (2016.08)

(56) References Cited

U.S. PATENT DOCUMENTS

| | | | | |
|---|---|---|---|---|
| 2011/0163681 | A1* | 7/2011 | Dau | F21K 9/235 315/191 |
| 2011/0211352 | A1 | 9/2011 | Reingruber | |
| 2011/0286200 | A1 | 11/2011 | Iimura et al. | |
| 2012/0033407 | A1 | 2/2012 | Barta | |
| 2013/0234613 | A1* | 9/2013 | McCune, Jr. | H05B 33/0815 315/200 R |
| 2013/0271981 | A1 | 10/2013 | Hussell et al. | |
| 2015/0061536 | A1* | 3/2015 | Xie | H05B 33/0845 315/291 |
| 2017/0205124 | A1* | 7/2017 | Staines | F25D 19/00 |

FOREIGN PATENT DOCUMENTS

| | | | |
|---|---|---|---|
| CN | 202008009 | U | 10/2011 |
| CN | 103672460 | A | 3/2014 |
| JP | 2010015798 | A | 1/2010 |
| JP | 2012028245 | A | 2/2012 |
| KR | 453761 | Y1 | 5/2011 |
| TW | 459357 | U1 | 8/2013 |
| WO | WO2008141343 | A1 | 11/2008 |

* cited by examiner

LIGHTING DEVICE COMPRISING A DRIVER UNIT AND METHOD OF MANUFACTURING THE SAME

CROSS-REFERENCE TO PRIOR APPLICATIONS

This application is the U.S. National Phase application under 35 U.S.C. § 371 of International Application No. PCT/EP2016/052731, filed on Feb. 9, 2016, which claims the benefit of European Patent Application No. 15154806.2, filed on Feb. 12, 2015. These applications are hereby incorporated by reference herein.

FIELD OF THE INVENTION

The present invention generally relates to the field of lighting devices and methods of manufacturing such lighting devices.

BACKGROUND OF THE INVENTION

The use of light-emitting diodes (LED) for illumination purposes continues to attract attention. Compared to incandescent bulbs, LEDs provide numerous advantages such as a longer operational life and an increased efficiency related to the ratio between light energy and heat energy. LED lamps may be used for a general lighting or even for a more specific lighting, as the color and the output power of the LEDs may be tuned.

Light-emitting arrangements in the prior art, which comprise LEDs, may further comprise a transformer for a transfer of electrical energy and for a change of AC voltages from a voltage level to another. Hence, a light-emitting arrangement may be coupled to a source of electricity having a first voltage, whereby the LEDs in the light-emitting arrangement may be supplied with a second voltage, different to the first voltage and electrically isolated from the first voltage, by means of a transformer.

However, light-emitting arrangements comprising transformers according to the prior art are often complicated and circumstantial in their design. Hence, alternative solutions are of interest which are able to provide a safer and more convenient lighting device structure, and which furthermore are able to provide a more cost-effective lighting device as well as a more cost-effective method of manufacturing the lighting device.

SUMMARY OF THE INVENTION

It is an object of the present invention to mitigate the above problems and to provide a lighting device, as well as a method of manufacturing the lighting device, which is safe, convenient and/or cost-effective.

This and other objects are achieved by providing a lighting device and a method of manufacturing a lighting device having the features in the independent claims. Preferred embodiments are defined in the dependent claims.

Hence, according to a first aspect of the present invention, there is provided a lighting device comprising at least one light source arranged to generate light and a light-transmissive envelope enclosing the at least one light source and being arranged to transmit the light generated from the at least one light source. The lighting device further comprises a driver unit arranged for electrical supply to the at least one light source. The driver unit comprises a primary driver circuit connectable to an electric energy source, at least one secondary driver circuit connected to the at least one light source and a transformer arranged to transfer electrical energy between the primary driver circuit and the at least one secondary driver circuit, wherein at least the transformer and the at least one secondary driver circuit are arranged within the light-transmissive envelope.

According to a second aspect of the present invention, there is provided a method of manufacturing a lighting device. The method comprises the step of providing at least one light source arranged to generate light. The method further comprises the step of providing a light-transmissive envelope for enclosing the at least one light source and being arranged to transmit the light generated from the at least one light source. The method further comprises the step of providing a driver unit arranged for electrical supply to the at least one light source, wherein the driver unit comprises a primary driver circuit connectable to an electric energy source, at least one secondary driver circuit connectable to the at least one light source, and a transformer arranged to transfer electrical energy between the primary driver circuit and the at least one secondary driver circuit. The method further comprises the step of arranging at least the transformer and the at least one secondary driver circuit within the light-transmissive envelope.

Thus, the present invention is based on the idea of providing a lighting device comprising one or more light sources, a light-transmissive envelope enclosing the light source(s) and being arranged to transmit the light generated from the light source(s), and a driver unit for a supply of electrical energy to the light source(s) of the lighting device via a transformer, wherein at least the transformer and the secondary driver circuit(s) of the driver unit are (completely) arranged within the light-transmissive envelope of the lighting device. It will be appreciated that the lighting device is hereby able to isolate the transformer and the secondary driver circuit(s) of the driver unit within its isolating, light-transmissive envelope, which leads to a construction which ensures electrical safety during operation of the lighting device. Furthermore, the lighting device of the present invention is convenient and compact in its structure, as the transformer and secondary driver circuit(s) of the driver unit are arranged within (integrated into) the light-transmissive envelope of the lighting device. Hence, compared to light-emitting arrangements comprising transformers in the prior art, which arrangements often are unsafe during operation and complicated, circumstantial and/or expensive in their constructions, the lighting device of the present invention provides a significantly safer, more convenient and more cost-effective lighting device.

The present invention is advantageous in that the transformer and the secondary driver circuit(s) of the driver unit are completely arranged within the light-transmissive envelope of the lighting device. The envelope is hereby able to fully isolate these components of the driver unit for a supply of electricity to the at least one light source. Hence, the light-transmissive envelope of the lighting device of the present invention is not only able to transmit the light generated by the at least one light source during operation, but is also able to isolate and/or protect the transformer and the secondary driver circuit(s) of the driver unit for the supply of electrical energy to the at least one light source. Consequently, as the driver unit, which comprises a primary driver circuit, at least one secondary driver circuit and a transformer, is at least partially arranged within the envelope of the lighting device, the lighting device is able to ensure electrical safety during its operation.

It will be appreciated that the arrangement of the driver unit at least partially within the light-transmissive envelope of the lighting device further results in a lighting device having a compact and cost-saving structure.

The present invention is further advantageous in that the lighting device of the present invention is conveniently optimized with respect to the characteristics of the light source(s), such as the number of light sources, the luminous flux output of the light sources, etc. For example, in case of a change of the characteristics of the light sources, there may be a need of a different voltage supply at the same current (V/I ratio). In systems according to the prior art, a change of the light source characteristics would often require a change of the driver arrangement and/or design. In contrast, the lighting device of the present invention conveniently overcomes such a change in that only the secondary driver circuit(s) need(s) to be replaced whereas the primary driver circuit does not need to be replaced. In other words, the present invention provides a lighting device with a tunable driver unit concept for the voltage supply to the light source(s). Furthermore, whereas the secondary driver circuit(s) may be replaced, the primary driver circuit may be used for many different kinds of lighting devices having different luminous flux outputs.

The present invention is further advantageous in that the light-transmissive envelope of the present invention may consist of a single material (e.g. glass) for the simultaneous purposes of a transmission of light from the at least one light source and an efficient isolation of at least a part of the driver unit. Consequently, the envelope of the present invention leads to an even more cost-effective lighting device.

The present invention is further advantageous in that the lighting device may re-use one or more components of a conventional incandescent lamp arrangement, thereby further contributing to the cost-effectiveness of the lighting device. For example, components of an incandescent lamp arrangement such as the flare, lead-in wires and/or the exhaust tube may constitute component(s) of the lighting device of the present invention.

The present invention is further advantageous in that the assembly of the lighting device during manufacture is simplified compared to the assembly of prior art arrangements. It will be appreciated that the assembly effort of the lighting device of the present invention is significantly reduced since at least a part of the assembly of the driver unit may form part of the assembly of the lighting device, which can be performed at a relatively high speed on a classical production line. Hence, the present invention is able to reduce both the bill of materials and the cost of assembly compared to prior art processes. Consequently, the lighting device of the present invention is relatively inexpensive, which also holds for the manufacture of the lighting device.

The present invention is further advantageous in that the relatively low number of components of the lighting device compared to many prior art arrangements implies an easier recycling of the lighting device, especially compared to arrangements comprising a relatively high number of devices and/or components which impede an easy disassembling and/or recycling operation.

It will be appreciated that the mentioned advantages of the lighting device of the present invention also hold for the method of manufacturing such a lighting device.

The lighting device of the present invention comprises at least one light source arranged to generate light. The lighting device further comprises a light-transmissive envelope enclosing the at least one light source and being arranged to transmit the light generated from the light source(s). By "light-transmissive envelope", it is here meant substantially any structure such as a bulb, casing, cover, or the like, which furthermore comprises (or consists of) an at least partially translucent material, such that the envelope hereby is able to transmit light generated by the light source(s).

The lighting device of the present invention further comprises a driver unit arranged for electrical supply to the at least one light source. The driver unit comprises a primary driver circuit connectable to an electric energy source, at least one secondary driver circuit connected to the at least one light source and a transformer arranged to transfer electrical energy between the primary driver circuit and the secondary driver circuit(s). By "transformer", it is here meant substantially any means for transferring electrical energy and for a change of AC voltages from a (first) voltage level to another (second) voltage level. Hence, from an electric energy source having a first voltage level, the driver unit of the lighting device of the present invention may supply a second voltage level to the at least one light source via the transformer.

According to an embodiment of the present invention, the driver unit is arranged within the envelope. Hence, in this embodiment of the present invention, the entire driver unit comprising the primary driver circuit, the transformer and the secondary driver circuit(s) is arranged within the envelope. The present embodiment is advantageous in that the entire driver unit is completely arranged within the light-transmissive envelope of the lighting device such that the envelope is able to fully isolate the driver unit.

According to an embodiment of the present invention, the primary driver circuit is arranged at a base portion of the envelope. By "base portion", it is here meant a portion of the light-transmissive envelope arranged to be connected to a socket, or the like, for an electrical connection of the lighting device. In case the envelope of the lighting device has the form of a (pear-shaped) bulb, it will be appreciated that the "base portion" may constitute a part of the lower portion of the envelope having a smaller circumference than the upper bulb portion of the envelope. It will be appreciated that the base portion may comprise or constitute a screw base (cap) of the lighting device. The present embodiment is advantageous in that the primary driver is easily and conveniently connectable to an (external) electric energy source.

According to an embodiment of the present invention, the lighting device may further comprise a support structure arranged within the envelope, wherein the at least one secondary driver circuit and the at least one light source are arranged on the support structure. By "support structure", it is here meant substantially any element arranged for mechanical and/or electrical support of one or more components of the lighting device. The present embodiment is advantageous in that the support structure provides a convenient arrangement of the secondary driver circuit(s) and the light source(s) within the interior of the light-transmissive envelope of the lighting device. The present embodiment is further advantageous in that the support structure, on which the light source(s) are arranged, is able to provide a desired light-emitting direction of the lighting device.

According to an embodiment of the present invention, the support structure is cylinder-shaped and at least partially encloses the transformer. The present embodiment is advantageous in that the support structure, on which the secondary driver circuit(s) and light source(s) may be arranged, may provide an omnidirectional light distribution of the lighting device. The present embodiment is further advantageous in that the shape and/or positioning of the support structure contribute(s) to a relatively tight (and hence space-saving) arrangement of the lighting device.

According to an embodiment of the present invention, the support structure may have a polygonal cross section. The present embodiment is advantageous in that the polygonal shape of the support structure provides (plane) areas of the support structure on which the secondary driver circuit(s) and light source(s) may be arranged, while still being able to provide a substantially omnidirectional light distribution.

According to an embodiment of the present invention, the transformer may comprise a core, a primary winding arranged around the core, an isolating element at least partially enclosing the primary winding, and a secondary winding arranged around the isolating element, wherein the lighting device may further comprise a stem element enclosing the core. By "stem element", it is here meant a (exhaust) tube or cylinder element, or the like, in which the core of the transformer is arranged. It will be appreciated that presently available incandescent lamp arrangements may be provided with exhaust tubes lamp for exhausting air out of the bulb and inserting one or more inert gases into the bulb during manufacturing, and the present embodiment is hereby advantageous in that the lighting device according to the present invention may re-use such an exhaust tube. Consequently, the present embodiment leads to an even more cost-effective lighting device as well as an even more cost-effective method of manufacturing the lighting device. Furthermore, the present embodiment is advantageous in that an even thinner, more compact and/or more convenient lighting device may be provided.

According to an embodiment of the present invention, the stem element may further enclose the primary winding. Hence, in this embodiment of the present invention, the stem element may enclose the core and the primary winding of the transformer. The present embodiment is advantageous in that it achieves a reduction of space between the core and the windings, resulting in an even more compact lighting device. The present embodiment is further advantageous in that the lighting device becomes even easier to manufacture, as relatively few glass parts are used during the assembly of the lighting device. The present embodiment is further advantageous in that the magnetic coupling of the lighting device is improved.

According to an embodiment of the present invention, the stem element may be cylinder-shaped and may extend from a base portion of the envelope into the interior of the envelope. It will be appreciated that the stem element may be the same as the exhaust tube of an incandescent lamp, and the present embodiment is hereby advantageous in that the lighting device according to the present invention may re-use such an exhaust tube.

According to an embodiment of the present invention, the isolating element and/or the stem element may comprise glass. In other words, at least one of the isolating element and the stem element may comprise glass. The present embodiment is advantageous in that glass has a relatively high resistivity, and is electrically insulating. The present embodiment is further advantageous in that glass is a relatively inexpensive material, leading to an even more cost-effective lighting device as well as a more cost-effective method of manufacturing the lighting device.

According to an embodiment of the present invention, the transformer may further comprise a first core element shaped as a cylinder and arranged around the secondary winding, and at least one second core element arranged on one of the circumferential rims of the first core element. Hence, in addition to the core of the transformer, the transformer of the present embodiment further comprises a cylinder-shaped first core element arranged around the secondary winding and at least one second core element arranged as a lid on one or both end portions of the first core element. The present embodiment is advantageous in that the coupling between the primary and the secondary windings of the transformer is even further improved by means of the first and second core element(s).

According to an embodiment of the present invention, the envelope is bulb-shaped. Hence, in the present embodiment, the light-transmissive envelope of the lighting device has the form of a (pear-shaped) bulb. The present embodiment is advantageous in that the light source(s) and the driver unit of the lighting device may fit conveniently within the envelope. Furthermore, as bulb-shaped envelopes are commonly used in incandescent lamp arrangements according to the prior art, the present embodiment is advantageous in that the lighting device according to the present invention may re-use the envelope of these incandescent lamp arrangements, leading to an even more cost-effective lighting device and a method of manufacture of the lighting device which is convenient and cost-effective.

According to an embodiment of the present invention, the envelope may comprise glass. The present embodiment is advantageous in that the use of glass for the light-transmissive envelope allows both a transmission of the light generated by the at least one light source during operation as well as an efficient isolation and/or protection of the driver unit.

According to an embodiment of the present invention, the at least one light source may comprise at least one light emitting diode (LED). The present embodiment is advantageous in that LEDs provide numerous advantages compared to incandescent lamps, such as a longer operational life and an increased efficiency related to the ratio between light energy and heat energy.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
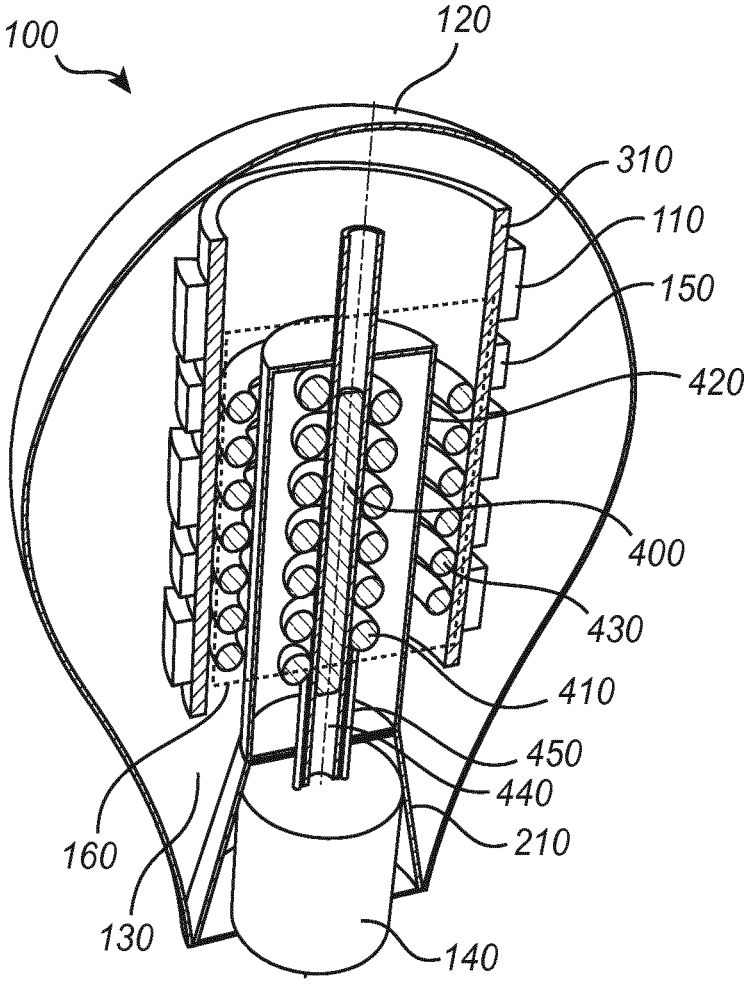
FIGS. 1-3 are schematic, cross-sectional views of lighting devices according to exemplifying embodiments of the present invention.

FIG. 1 is a schematic, cross-sectional view of a lighting device 100 according to an embodiment of the present invention. The lighting device 100 comprises at least one light source 110 arranged to generate light, wherein the light sources 110 in FIG. 1 are schematically indicated as light-emitting diodes (LEDs). The lighting device 100 further comprises a light-transmissive envelope 120 enclosing the light source(s) 110 and being arranged to transmit the light generated from the light source(s) 110. Here, the light-transmissive envelope 120 is shown to have the shape of a bulb, but it will be appreciated that the envelope 120 may take substantially any other form. The material of the light-transmissive envelope 120 is preferably glass, but it will be appreciated that the light-transmissive envelope 120 may comprise substantially any other translucent material.

The lighting device 100 further comprises a driver unit 130 arranged for an electrical supply to the light source(s) 110. The driver unit 130 comprises a primary driver circuit 140 which is connectable to an electric energy source, e.g. a mains source. Here, the schematically indicated primary driver circuit 140 is provided in a base portion (cap) 210 of the envelope 120, wherein the base portion 210 may be connected to a socket, or the like, for an electrical connection of the lighting device 100. It will be appreciated that the base portion 210 may comprise or constitute a screw base (cap) of the lighting device 100.

The lighting device 100 further comprises at least one secondary driver circuit 150 connected to the light sources 110. In FIG. 1, the secondary driver circuit(s) 150 is (are) schematically indicated alongside the light source(s) 110. The lighting device 100 further comprises a support structure 310 arranged within the envelope 120, upon which support structure 310 the secondary driver circuit(s) 150 and the light source(s) 110 are arranged. It will be appreciated that the support structure 310 may furthermore comprise one or more substrates for the light source(s) 110. The material of the support structure may be a conventional printed circuit board (PCB) material such as CEM-3 or FR4. The support structure 310 in FIG. 1 is exemplified as having a cylinder shape, but it will be appreciated that the support structure 310 may take substantially any other shape. Furthermore, the cylinder-shaped support structure 310 may have a polygonal cross section, e.g. a quadratic or octagonal cross section. In such a case, the secondary driver circuit(s) 150 and the light source(s) 110 may be arranged on the (plane) areas of the support structure 310. It will be appreciated that the secondary driver circuit(s) 150 are removably arranged on the support structure 310, and are easily replaced by one or more other secondary driver circuit(s) if needed. The replacement of one or more secondary driver circuits 150 may form part of the tunable driver unit concept of the lighting device 100 for the voltage supply to the light source(s) 110.

The lighting device 100 further comprises a transformer 160 arranged to transfer electrical energy between the primary driver circuit 140 and the secondary driver circuit(s) 150. The transformer 160, which is schematically indicated by dashed lines, comprises a core 400, preferably a ferrite core, having the shape of a rod. The core 400 is arranged in a substantially central portion in the interior of the light-transmissive envelope 120. The core 400 is furthermore arranged within a cylinder or tube-shaped stem element 440 which elongates from the base portion 210 into the interior of the light-transmissive envelope 120. It will be appreciated that the stem element 440 may constitute the same component as the exhaust tube element of an incandescent lamp, through which air may be exhausted out of the bulb and one or more inert gases may be introduced into the bulb during manufacturing. The transformer 160 of the lighting device 100 further comprises a primary winding 410 arranged around the core 400, and an isolating element 420 at least partially enclosing the primary winding 410. Here, the isolating element 420 is cylinder-shaped, but may take substantially any other form. Preferably, the isolating element 420 and/or the stem element 440 comprise(s) or consist(s) of glass. A pair of lead-in wires 450 for an electrical connection between the primary driver circuit 140 and the primary winding 410 of the lighting device 100 is schematically indicated in FIG. 1. The transformer 160 of the lighting device 100 further comprises a secondary winding 430 arranged around the isolating element 420, and the secondary winding 430 is in turn at least partially enclosed by the support structure 310.

In a direction from the center of the lighting device 100 towards the light-transmissive envelope 120 of the lighting device 100, the lighting device 100 as exemplified in FIG. 1 hereby comprises a core 400, a stem element 440, a primary winding 410, an isolating element 420, a secondary winding 430, a support structure 310, (a) light source(s) 110 and (a) secondary driver circuit(s) 150. Thus, in the lighting device 100 of FIG. 1, the transformer 160 and the secondary driver circuit(s) 150 of the driver unit 130 are completely arranged within the light-transmissive envelope 120 of the lighting device 100. In an alternative, not-shown example of the lighting device 100, the entire driver unit 130 (i.e. the primary driver circuit 140, the secondary driver circuit(s) 150 and the transformer 160) may be arranged within the light-transmissive envelope 120 of the lighting device 100.

Figure 2:
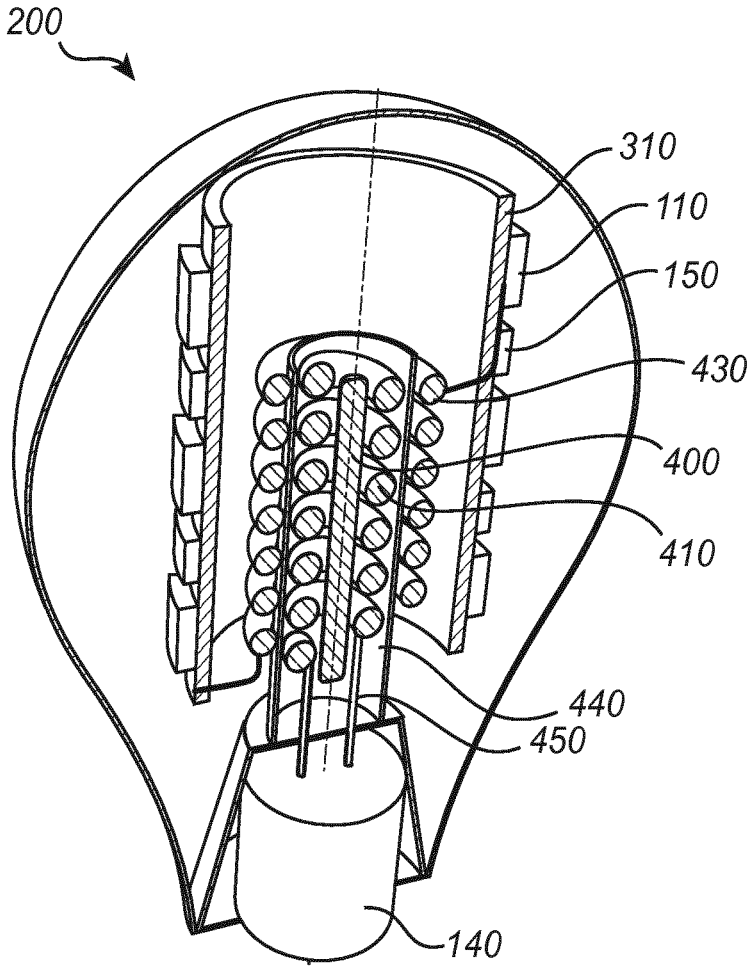

FIG. 2 is a schematic, cross-sectional view of a lighting device 200 according to an embodiment of the present invention. It will be appreciated that many features and/or components of the lighting device 200 are similar and/or arranged similarly to those of the lighting device 100 of FIG. 1, such as the light source(s) 110, the primary driver circuit 140, the secondary driver circuit(s) 150, the support structure 310, etc., and it is hereby referred to that portion of the text. In the embodiment of the lighting device 200 of FIG. 2, however, the stem element 440 encloses both the core 400 as well as the primary winding 410. Furthermore, compared to the lighting device 100 of FIG. 1, there is no cylinder-shaped isolating element present, as the isolation between the (ferrite) core 400 and the primary winding 410 is instead provided by varnish applied on the primary winding 410.

Figure 3:
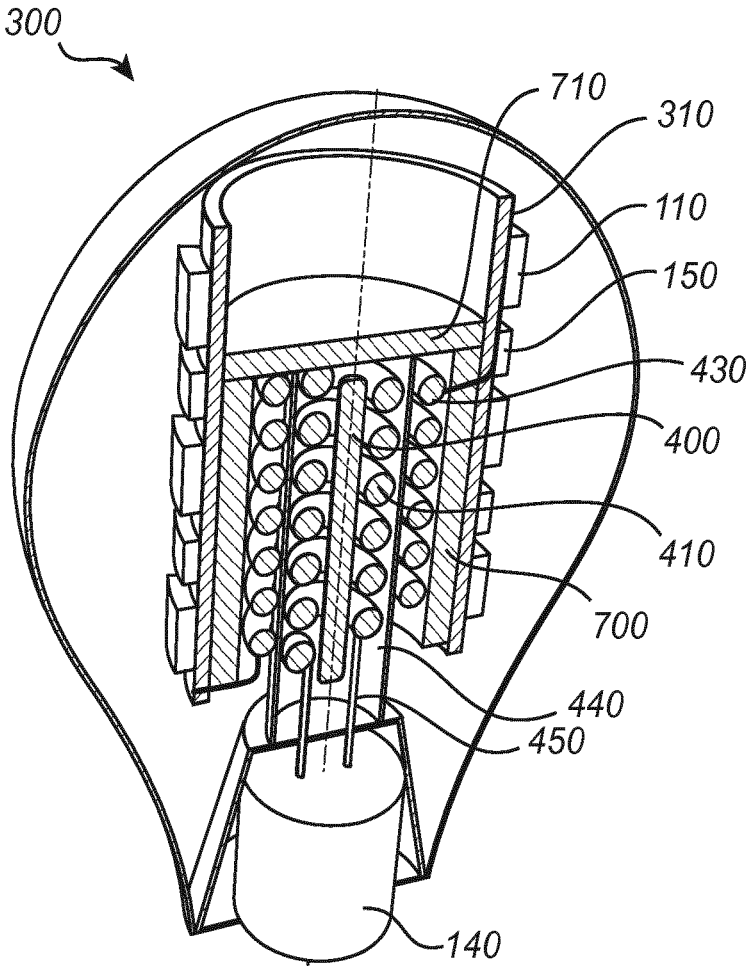

FIG. 3 is a schematic, cross-sectional view of a lighting device 300 according to an embodiment of the present invention. Again, many features and/or components of the lighting device 300 are similar and/or arranged similarly to those of the lighting device 100 of FIG. 1 and/or the lighting device 200 of FIG. 2, and it is hereby referred to these portions of the text. Similarly to the lighting device 200 of FIG. 2, the stem element 440 of the embodiment of the lighting device 300 shown in FIG. 3 encloses both the core 400 as well as the primary winding 410. Furthermore, the transformer 160 comprises a first core element 700 shaped as a cylinder and arranged around said secondary winding 430, i.e. between the secondary winding 430 and the support structure 310. The transformer 160 further comprises a second core element 710 which is arranged as a lid on the upper circumferential rim of the first core element 700. Alternatively, or in addition, there may be provided a second core element (not shown) arranged on the lower circumferential rim of the first core element 700. It will be appreciated that the material of the first core element 700 and/or the second core element 710 may be the same as that of the core element 400, e.g. ferrite.

The person skilled in the art realizes that the present invention by no means is limited to the preferred embodiments described above. On the contrary, many modifications and variations are possible within the scope of the appended claims. For example, it will be appreciated that the figures are merely schematic views of lighting devices according to embodiments of the present invention. Hence, any elements/components of the lighting device(s) 100, 200, 300 such as the driver unit 130 and the light source(s) 110 may have different dimensions, shapes and/or sizes than those depicted and/or described. For example, the number of light source(s)

110 and/or secondary driver circuit(s) 150 may be larger or lower than what is exemplified in the figures. Furthermore, the primary winding 410 and the secondary winding 430 are in the figures are enlarged in the figures for a better understanding.

The invention claimed is:

1. A lighting device, comprising at least one light source arranged to generate light, a light-transmissive envelope enclosing said at least one light source and being arranged to transmit the light generated from said at least one light source, a driver unit arranged for electrical supply to said at least one light source, said driver unit comprising a primary driver circuit connectable to an electric energy source, at least one secondary driver circuit connected to said at least one light source, and a transformer arranged to transfer electrical energy between said primary driver circuit and said at least one secondary driver circuit, and a support structure arranged within said envelope, wherein said at least one secondary driver circuit of said driver unit is arranged within said envelope and said at least one secondary driver circuit and said at least one light source are arranged on said support structure, and said support structure being cylinder-shaped and including at least one outer wall defining a cavity, wherein said outer wall at least partially encloses said transformer in said cavity, characterized in that at least said primary driver circuit, said transformer and said at least one secondary driver circuit of said driver unit are arranged within said envelope.

2. The lighting device according to claim 1, wherein said driver unit is arranged within said envelope.

3. The lighting device according to claim 1, wherein said support structure has a polygonal cross section.

4. The lighting device according to claim 1, wherein said transformer comprises a core, a primary winding arranged around said core, an isolating element at least partially enclosing said primary winding, and a secondary winding arranged around said isolating element, wherein said lighting device further comprises a stem element enclosing said core.

5. The lighting device according to claim 4, wherein said stem element further encloses said primary winding.

6. The lighting device according to claim 4, wherein said stem element is cylinder-shaped and extends from a base portion of said envelope into the interior of said envelope.

7. The lighting device according to claim 4 wherein said isolating element and/or said stem element comprises glass.

8. The lighting device according to claim 1, wherein said envelope is bulb-shaped.

9. The lighting device according to claim 1, wherein said envelope comprises glass.

10. The lighting device according to claim 1, wherein said at least one light source comprises at least one light emitting diode.

11. A lighting device, comprising:

at least one light source arranged to generate light, a light-transmissive envelope enclosing said at least one light source and being arranged to transmit the light generated from said at least one light source, and a driver unit arranged for electrical supply to said at least one light source, said driver unit comprising a primary driver circuit connectable to an electric energy source, at least one secondary driver circuit connected to said at least one light source, and a transformer arranged to transfer electrical energy between said primary driver circuit and said at least one secondary driver circuit, characterized in that at least said primary driver circuit, said transformer and said at least one secondary driver circuit of said driver unit are arranged within said envelope, wherein said transformer comprises a core, a primary winding arranged around said core, an isolating element at least partially enclosing said primary winding, and a secondary winding arranged around said isolating element, wherein said transformer further comprises a first core element shaped as a cylinder and arranged around said secondary winding, and at least one second core element arranged on one of the circumferential rims of said first core element.

12. A method of manufacturing a lighting device, comprising the steps of:

providing at least one light source arranged to generate light, providing a light-transmissive envelope for enclosing said at least one light source and being arranged to transmit the light generated from said at least one light source, providing a driver unit arranged for electrical supply to said at least one light source, said driver unit comprising a primary driver circuit connectable to an electric energy source, at least one secondary driver circuit connectable to said at least one light source, and a transformer arranged to transfer electrical energy between said primary driver circuit and said at least one secondary driver circuit, and providing a support structure arranged within said envelope, wherein said at least one secondary driver circuit of said driver unit is arranged within said envelope and said at least one secondary driver circuit and said at least one light source are arranged on said support structure, and said support structure being cylinder-shaped and including at least one outer wall defining a cavity, wherein said outer wall at least partially encloses said transformer in said cavity, characterized by:

arranging at least said primary driver circuit, said transformer and said at least one secondary driver circuit of said driver unit within said envelope.

* * * * *